United States Patent [19]

Merritt

[11] Patent Number: 4,796,785

[45] Date of Patent: Jan. 10, 1989

[54] APPARATUS FOR HOLDING AND DISPENSING BEVERAGES

[76] Inventor: Timothy K. Merritt, 117 Arbor Park North, Louisville, Ky. 40214

[21] Appl. No.: 86,938

[22] Filed: Aug. 17, 1987

[51] Int. Cl.[4] ..... B67D 5/42

[52] U.S. Cl. ..... 222/131; 222/387; 220/93

[58] Field of Search ..... 222/131, 183, 386, 387, 222/465.1, 475.1, 478, 481, 481.5; 220/93

[56] References Cited

U.S. PATENT DOCUMENTS

| | | | |
|---|---|---|---|
| 33,637 | 11/1861 | Dungan | 222/387 |
| 112,082 | 2/1871 | Shaneman et al. | 222/387 |
| 146,964 | 1/1874 | Vallentin | 222/387 X |
| 1,630,899 | 5/1927 | Lynch | 222/387 |
| 1,936,857 | 11/1933 | Reisdorf | 222/387 X |
| 2,659,517 | 11/1953 | Reinhardt, Jr. | 222/387 X |
| 3,224,745 | 12/1965 | Hotchkiss | 222/250 |
| 3,682,356 | 8/1972 | Karle | 222/132 |
| 3,987,941 | 10/1976 | Blessing | 222/386 |

FOREIGN PATENT DOCUMENTS

| | | | |
|---|---|---|---|
| 2120683 | 2/1972 | Fed. Rep. of Germany | 222/56 |

*Primary Examiner*—Michael S. Huppert
*Attorney, Agent, or Firm*—Norman B. Rainer

[57] ABSTRACT

Apparatus is provided for storing and dispensing beverages while excluding air from contact with the beverage and maintaining it at a desired temperature. The apparatus is comprised of a vessel having a cylindrical sidewall, an open upper extremity, and a bottom drain conduit. Thermal insulation is disposed upon the entire outer surface of the vessel. A piston is adapted to enter the open upper extremity of the vessel and make tight-fitting sliding engagement with the sidewall. A thermally insulative lid is disposed above the piston in sealing engagement with the upper extremity.

1 Claim, 1 Drawing Sheet

APPARATUS FOR HOLDING AND DISPENSING BEVERAGES

BACKGROUND OF THE INVENTION

This invention relates to the holding of beverages for periods of time at a desired temperature with minimal exposure to air, and dispensing said beverage in sequential portions during said periods of time.

Many food service establishments prepare a large batch quantity of a beverage, particularly coffee, which is dispensed as individual serving portions throughout a business day. In the course of such prolonged holding time, the coffee is maintained at elevated temperature and in contact with air. The oxidative effects of air under such holding conditions causes degradation of the flavor components of the coffee. Evaporative effects produced by exposure of the surface of the beverage to air cause a concentration of the coffee with attendant intensification of undesirable degradation products. Unless the vessel in which the beverage is maintained is properly insulated, considerable energy is required to maintain the elevated temperature for prolonged holding periods. Thus, cost control inefficiencies, waste and unsatisfactory customer product trial can result. Although preparing beverages in small batches may ameliorate the problem, it is disadvantageously labor intensive.

To a lesser degree, the same problems are encountered with the bulk production and maintenance of hot tea for serving, as occurs in oriental restaurants.

In maintaining cold beverages such as fruit and vegetable juices in a ready-to-serve condition over prolonged periods of time, similar problems of air oxidation and high energy consumption are experienced.

Although thermally insulated containers for liquids are well known, few are capable of conveniently dispensing portions of the confined liquid, and even fewer are capable of excluding air from the diminishing volume of the stored liquid.

It is accordingly an object of the present invention to provide apparatus which maintains a beverage at desired temperature with minimal energy requirement and minimal exposure to air for a prolonged period of time, and from which said beverage can be conveniently dispensed as a series of individual servings during said period of time.

It is another object of this invention to provide apparatus as in the foregoing object which can be easily re-filled with beverage, and easily cleaned between fillings.

It is a further object of the present invention to provide apparatus of the aforesaid nature of rugged and durable construction amenable to low cost manufacture.

These objects and other objects and advantages of the invention will be apparent from the following description.

SUMMARY OF THE INVENTION

The above and other beneficial objects and advantages are accomplished in accordance with the present invention by a dispensing apparatus comprising:

(a) a confining vessel comprised of a circular cylindrical sidewall rising perpendicularly upward from a flat circular bottom panel and terminating in an open circular upper extremity, said sidewall and bottom panel being bounded by interior and exterior surfaces, the height of said vessel, measured along its center axis, being at least twice its diameter, (b) thermal insulation means disposed upon the exterior surfaces of said vessel, (c) a drain conduit which penetrates said thermal insulation means and said sidewall adjacent said bottom panel, (d) flow control means associated with said conduit exterior to said vessel, (e) a piston in close-fitting sliding engagement with the interior surface of said sidewall, said piston having upper and lower flat surfaces joined by a circular cylindrical boundary surface, (f) a straight stem rising perpendicularly upward from said piston in coaxial alignment with the axis of said vessel, and (g) a closure lid having thermal insulative means and having a perimeter adapted to make sealing engagement with the open upper extremity of the vessel, and having a centered aperture adapted to make close-fitting sliding engagement with said stem.

In preferred embodiments of the apparatus, an outer shell fabricated of a material such as stainless steel or plastic may be disposed upon the exterior surfaces of the thermal insulation. The thermal insulation means is preferably a closed cell polymer foam. A vacuum chamber may be utilized in addition to foam material as a component of the insulation means. The cylindrical boundary surface of the piston may be equipped with O-rings adapted to make an air-tight seal with the interior surface of the sidewall of the vessel.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
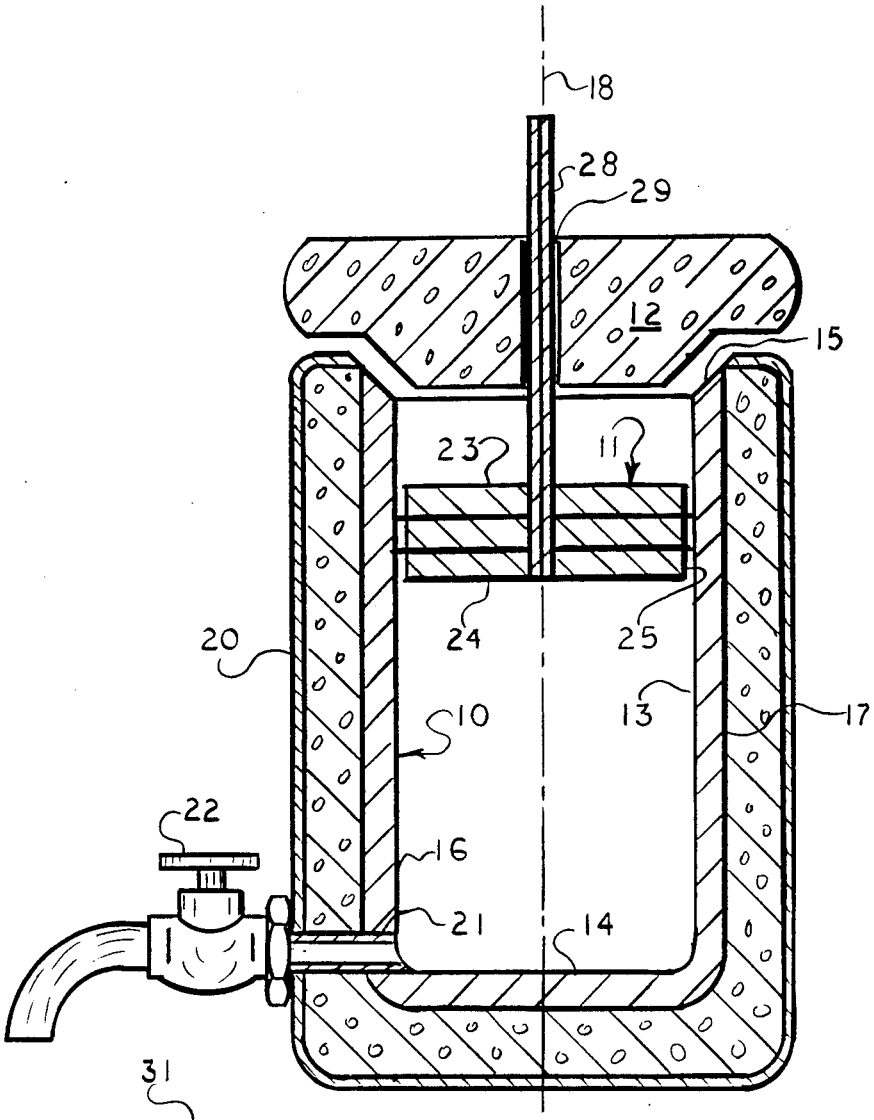
FIG. 1 is a vertical sectional view of an embodiment of the apparatus of the present invention.
Figure 2:
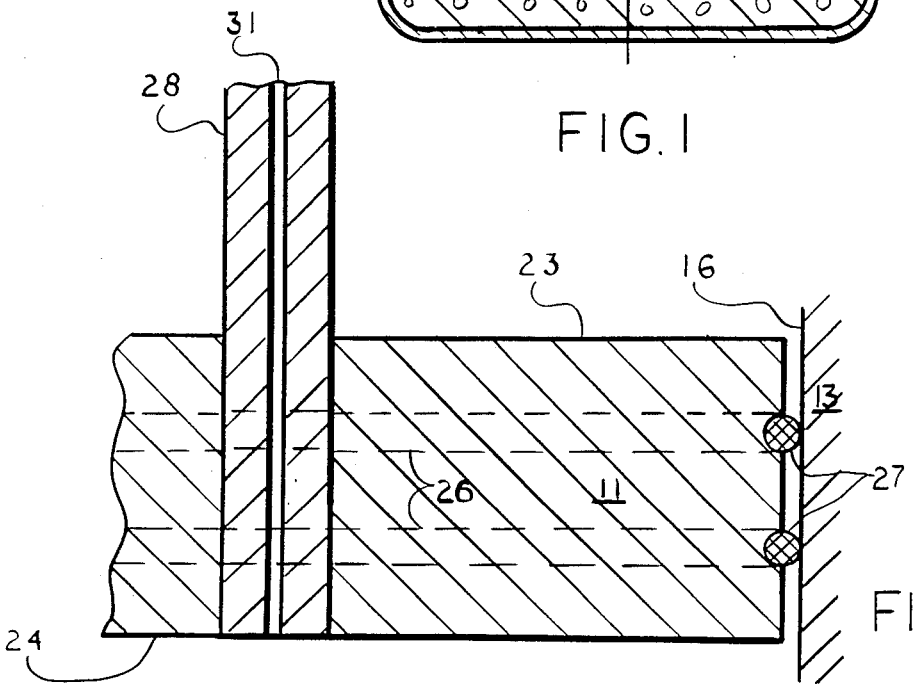
FIG. 2 is an enlarged fragmentary view of the piston component of the apparatus of FIG. 1.

Referring to FIGS. 1 and 2, an embodiment of the apparatus of the present invention is shown comprised of confining vessel 10 having piston 11 and associated closure lid 12.

The confining vessel is comprised of circular cylindrical sidewall 13 rising perpendicularly upward from flat circular bottom panel 14, and terminating in open circular upper extremity 15. The sidewall and bottom panel are bounded by interior and exterior surfaces 16 and 17, respectively. The vessel is upwardly elongated along center axis 18. The height of the illustrated vessel, measured along axis 18, is about 2 times greater than the diameter measured across the interior surface 16 of sidewall 13. In other embodiments, the ratio of the height to diameter of the vessel may range as high as 3.0. The vessel is preferably fabricated of a plastic by a molding operation. Suitable plastics should desirably be scratch and stain resistant, have low thermal conductivity, high resistance to thermal deformation and degradation, and should be devoid of ingredients such as plasticizers and residual catalysts that can be leached out by hot fluids. A specifically suitable plastic is the melamine-formaldehyde resin generally known by the trademark Melmac.

Thermal insulation means in the form of a uniform layer of closed cell polymer foam 19 is disposed upon the exterior surfaces of the vessel. Suitable polymers may be rigid, semi-rigid, or flexible varieties of polystyrene, polyethylene, polyurethane, neoprene, and equivalent synthetic polymers. The polymer foam may be applied as cut slab stock which is adhered onto the exterior surfaces of the vessel, or the foam may be generated or cast in place upon said exterior surfaces.

An outer jacket 20 of thin cross-sectional thickness is disposed upon the polymer foam layer of the illustrated embodiment. The jacket, which may be fabricated of stainless steel or an impervious plastic, enables the apparatus to be subjected to rigorous periodic washings.

A tubular drain conduit 21 penetrates the vessel, insulation and jacket at a site adjacent bottom panel 14 and radially oriented with respect to axis 18. A conventional sealant may be applied to the exterior surface of the conduit to prevent leakage of liquid from the vessel. In an alternative embodiment, conduit 21 is a continuous integral extension of the vessel, having been formed in the same molding operation that creates the vessel.

Flow control means in the form of turnable on-off valve 22, fabricated of a thermally insulative material, is associated with said conduit exterior to said vessel.

Piston 11, fabricated of thermally insulative material, is comprised of upper and lower flat surfaces 23 and 24, respectively, joined by circular cylindrical boundary surface 25. Said boundary surface is provided with annular retaining grooves 26 which seat O-rings 27 which make tight-fitting sliding contact with the interior surface 16 of the sidewall of the vessel. However, the nature of the tight-fitting sliding contact is such that the piston, by gravity effect, falls to the surface of the liquid within the vessel, and by bouyancy effect rests upon the surface of the liquid. In such manner, the piston rides upon the liquid surface regardless of its level, and prevents air from contacting the liquid.

A straight stem 28 rises perpendicularly upward from upper surface 23 of the piston in coaxial alignment with axis 18. The stem facilitates the manual removal of the piston for the purpose of re-filling and cleaning the vessel. In some embodiments, the stem may be of hollow construction, having an axially disposed capillary channel 31, as shown more clearly in FIG. 2, adapted to vent off any air trapped below lower surface 24 of the piston. The stem may be provided with manual or automatic means to close channel 31.

Closure lid 12 is fabricated of thermally insulative material and is configured to fit in sealing engagement with the open upper extremity 15 of the vessel. Aperture 29, centered within clsoure lid 12 permits close-fitting penetrative passage of stem 28. The nature of the sealing engagement of the lid with the stem and vessel is such that just sufficient air is allowed to leak into the space above the piston to allow the piston to fall by gravity force.

By virtue of the special nature of the aforesaid components and their interrelationships, beverage can be controllably withdrawn from the vessel while maintaining the beverage at a desired temperature and out of contact with air. For cleaning and refilling purposes, the lid and piston are quickly and easily removed, and new beverage can rapidly be poured into the large open upper extremity 15.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A beverage dispensing apparatus comprising:

(a) a confining vessel comprised of a circular cylindrical sidewall rising perpendicularly upward from a flat circular bottom panel and terminating in an open circular upper extremity, said sidewall and bottom panel being bounded by interior and exterior surfaces, the height of said vessel, measured along its center axis, being at least twice its diameter, (b) thermal insulation comprised of closed cell polymer foam disposed upon the exterior surfaces of said vessel, and an outer shell of durable impervious material disposed upon said insulation, (c) a drain conduit which penetrates said thermal insulation means and said sidewall adjacent said bottom panel, (d) flow control means associated with said conduit exterior to said vessel, (e) a piston having upper and lower flat surfaces joined by a circular cylindrical boundary surface disposed in close-fitting sliding engagement with the interior surface of said sidewall, said boundary surface being equipped with at least two O-rings in spaced apart relationship and adapted to make an air-tight seal with the interior surface of the sidewall of the vessel, (f) a straight stem rising perpendicularly upward from said piston in coaxial alignment with the axis of said vessel, said stem being of hollow construction and adapted to vent off any air trapped below the lower surface of the piston, and (g) a thermal insulative closure lid having a perimeter adapted to make sealing engagement with the open upper extremity of the vessel, and having a centered aperture adapted to make close-fitting sliding engagement with said stem.

* * * * *